US005647958A

United States Patent [19]

Schmidt-Rohr et al.

[11] Patent Number: 5,647,958

[45] Date of Patent: Jul. 15, 1997

[54] WIRE PART OF A MACHINE FOR THE MANUFACTURE OF FIBROUS MATERIAL WEBS

[75] Inventors: Volker Schmidt-Rohr; Hans-Peter Sollinger, both of Heidenheim; Klaus Henseler, Titisee-Neustadt; Klaus Esslinger, Nattheim, all of Germany

[73] Assignee: Voith Sulzer Papiermaschinen GmbH, Heidenheim, Germany

[21] Appl. No.: 471,010

[22] Filed: Jun. 6, 1995

[30] Foreign Application Priority Data

Jun. 16, 1994 [DE] Germany ..... 44 20 801.4

[51] Int. Cl.[6] ..... D21F 1/00; D21F 9/02

[52] U.S. Cl. ..... 162/203; 162/209; 162/210; 162/217; 162/264; 162/300; 162/301; 162/307; 162/310

[58] Field of Search ..... 162/300, 301, 162/203, 209, 217, 264, 310, 307, 210

[56] References Cited

U.S. PATENT DOCUMENTS

| | | | |
|---|---|---|---|
| 3,565,757 | 2/1971 | Jordansson | 162/301 |
| 3,846,232 | 11/1974 | Kankaanpaa | 162/301 |
| 3,997,390 | 12/1976 | Kankaanpaa | 162/132 |
| 4,116,763 | 9/1978 | Stoz et al. | 162/301 |
| 4,153,504 | 5/1979 | Justus | 162/133 |
| 4,154,645 | 5/1979 | Kankaanpää | 162/133 |
| 4,234,382 | 11/1980 | Schiel | 162/263 |
| 4,267,017 | 5/1981 | North | 162/190 |
| 4,285,768 | 8/1981 | Schiel | 162/301 |
| 4,925,531 | 5/1990 | Koski | 162/301 |
| 5,078,835 | 1/1992 | Schiel et al. | 162/352 |
| 5,102,501 | 4/1992 | Eber et al. | 162/129 |
| 5,252,186 | 10/1993 | Sollinger et al. | 162/273 |
| 5,259,929 | 11/1993 | Bubik et al. | 162/301 |
| 5,389,206 | 2/1995 | Bück et al. | 162/301 |
| 5,480,520 | 1/1996 | Esslinger | 162/301 |

FOREIGN PATENT DOCUMENTS

| | | | |
|---|---|---|---|
| 25 48 794 | 10/1975 | Germany | 162/301 |
| 41 02 065 | 7/1992 | Germany . | |
| 41 05 215 | 8/1992 | Germany . | |
| 43 01 103 | 8/1994 | Germany . | |
| WO91/02842 | 3/1991 | WIPO . | |

*Primary Examiner*—Donald E. Czaja
*Assistant Examiner*—Jose A. Fortuna
*Attorney, Agent, or Firm*—Marshall, O'Toole, Gerstein, Murray & Borun

[57] ABSTRACT

A wire part of a machine for the production of continuous fibrous material webs, especially a papermaking machine, includes two continuous wire belts which together form a twin-wire zone. At least one supporting element having a supporting surface is disposed in the region of the twin-wire zone. At least a part of the supporting surface provides a supporting region which supports a first wire belt on its inner surface and a second wire belt on its outer surface. At least one formation box is provided and is disposed in the supporting region. The formation box is designed in such a way that, in the region of the inner surface of the second wire belt in the formation box, pressure values can be adjusted from a reduced pressure to an excess pressure acting on the inner surface of the second wire belt. The formation box extends in the direction of movement of the wire part over at least a part of the supporting region.

37 Claims, 9 Drawing Sheets

WIRE PART OF A MACHINE FOR THE MANUFACTURE OF FIBROUS MATERIAL WEBS

BACKGROUND OF THE INVENTION

1. Field of the Invention

The invention relates to machines having a wire part for the manufacture of fibrous material webs, particularly for a papermaking machine wherein a web is guided between first and second continuous wire belts in a region of a twin-wire zone having a supporting surface and wherein at least a part of the supporting surface forms a supporting region which supports the first wire belt at an inner surface thereof and the second wire belt at an outer surface thereof.

2. Description of Related Technology

Wire parts of machines for the production of fibrous material webs, especially for papermaking machines with an integrated double-wire zone, have been known in various embodiments which are based on stringing together different variations of dewatering elements. For example, WO 91/02842 discloses a double-wire zone in which the dewatering of the fibrous material suspension is done between two continuous wire belts on dewatering elements combined with one another in different ways. Such dewatering elements are forming cylinders, forming shoes and embodiments with non-rigidly supported and rigid strips which are disposed alternately on the two sides of the two wire belts. The two wire belts with the fibrous material suspension between them are guided along these dewatering elements in order to dewater the suspension and form a web, whereby, due to the geometrical design of the individual dewatering elements, the consequently occurring wire tensions lead to intensification of the dewatering. The arrangement of non-rigidly supported strips, preferably on the lower wire, which are displaced to the gaps of the rigidly arranged strips that engage with the upper wire, results in the introduction of forces on the inner surface of the lower wire, which are manifested in line-like loads, which, due to the minimal cross-sectional changes and due to the high working speed, produce turbulences in the fibrous material suspension and prevent the formation of flocks. A disadvantage of the known arrangement is that, due to the relative movement between the upper wire and the rigid strips, the inner surface of the upper wire is subjected to wear phenomena. Also, the wire part has to be constructed quite long as a result of the sequential arrangement of the various dewatering elements.

An embodiment of a paper machine wire part is known from unpublished German Patent Application No. P 43 01 103 which avoids the disadvantages of the wire part disclosed in WO 91/02842. Supporting bodies are provided as dewatering elements, arranged in the double-wire zone, with pressure elements that act non-rigidly against their [of the wires'] supporting surface. Here, mainly supporting elements with continuous supporting surface come into consideration as supporting bodies, for example, forming cylinders and belts. This offers the advantage that the effects of centrifugal forces and the resulting pressure pulses can be added and thus dewatering is significantly promoted. Friction on the wire belt is largely avoided which is manifested in a reduction of wear and also in a reduction of the required driving forces. Supporting surfaces are chosen which are rigid in the direction of action of the pressure and which cannot deviate on the wire belts in the direction of pressure. The pressing of the pressure elements provides the advantage that line-like or point-like loads, and in the case of a corresponding design of the pressure element, even area-like loads are applied onto the wire belt which again results in desirable microturbulence in the fiber suspension between the wire belts. The pressure guided by the pressure element onto the inner surface of the wire belt can be varied, that is, can be adjusted so that it can be variably altered. The variation of the pressure applied by the pressure elements onto the inner surface of the wire can be continuous or step-wise. In order to adapt to changing operating conditions, the adjustment of the pressure value applied by the pressure elements can be integrated into a control or control system.

The disadvantages of the embodiments named in WO 91/02842 and P 43 01 103 consist mainly in the fact that the dewatering and the direction thereof are very difficult to control. Due to the elimination of water caused by the wire tension, damage of the fibrous material suspension occurs on the curved supporting bodies, and these are reflected by schlieren (streaks) in the finished fibrous material web. Another disadvantage is that no active influence can be exerted on the symmetrical formation of the fibrous material web or on control of the filler distribution.

SUMMARY OF THE INVENTION

It is an object of the invention to overcome one or more of the problems described above. Especially, based on intensification of the dewatering, additional controllability of the intensity and direction of dewatering as well as the ability to influence the symmetry of sheet formation and distribution of the fillers and fiber fines is to be realized. Defects during sheet formation should be avoided and thus uniformity of the produced fibrous material web should be increased. It should be possible to design the wire part in such a way that, in spite of higher dewatering performance, it would be characterized by a shorter constructed length.

According to the invention, a wire part and a method of operation thereof includes providing first and second continuous wire belts that define a twin-wire zone. At least one supporting element is disposed in a region of the twin-wire zone. The supporting element has a supporting surface wherein at least a part of the supporting surface supports, in a region called the supporting region, the first wire belt on an inner surface thereof and the second wire belt on an outer surface thereof. At least one formation box is disposed in the supporting region. The formation box is sealable against the atmosphere in a region of an inner surface of the second wire belt. The formation box extends in a direction of movement of the first and second wire belts and to at least a part of the supporting region. The wire part includes apparatus for adjusting pressure in the formation box.

In a method according to the invention, pressure in the formation box is adjusted in the region of the inner surface of the second wire belt to a value ranging between a reduced pressure and an excess pressure, the pressure adjustment being effective on the inner surface of the second wire belt.

Other objects and advantages of the invention will be apparent to those skilled in the art from the following detailed description taken in conjunction with the drawings and the appended claims.

DETAILED DESCRIPTION OF THE INVENTION

Figure 1A:
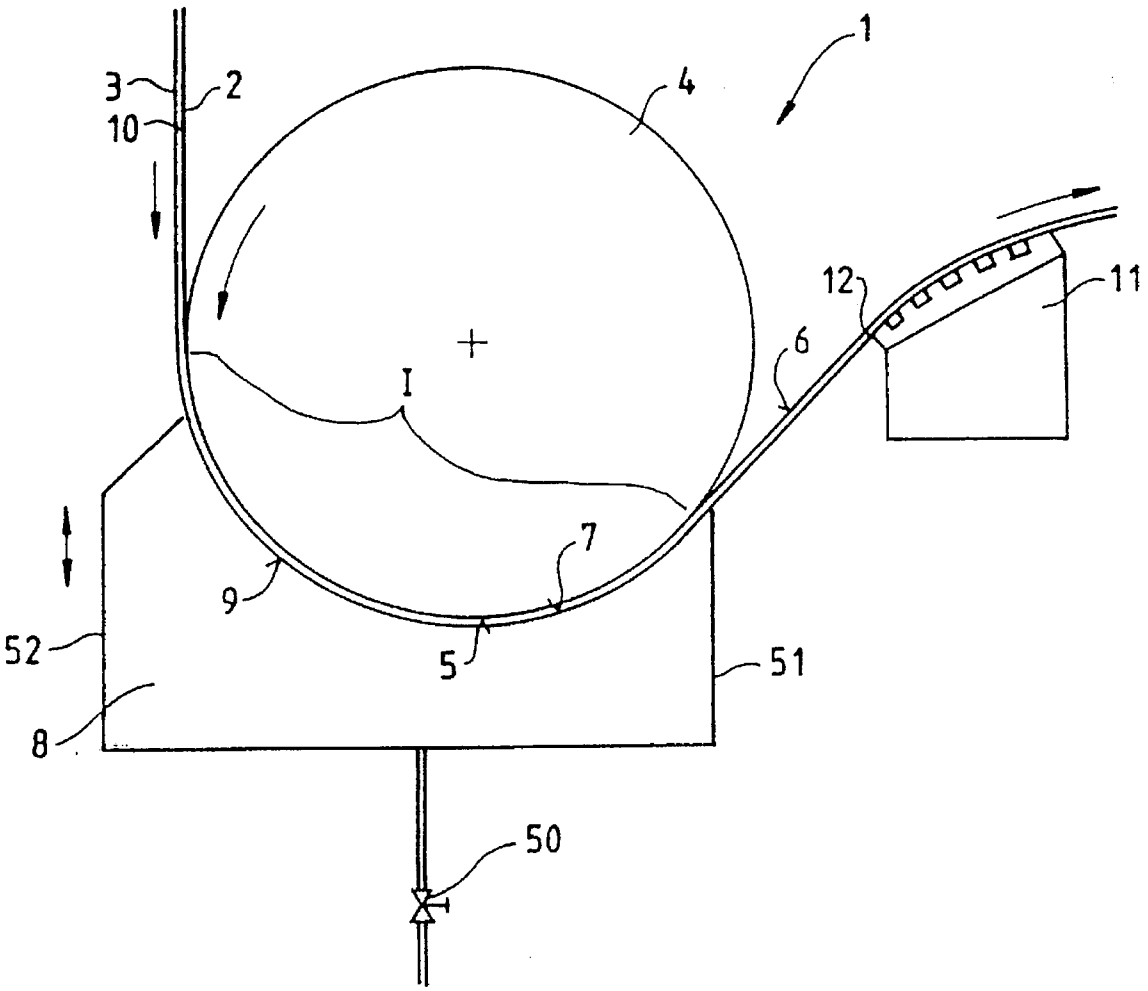
FIG. 1*a* is a partially schematic sectional view of a wire part according to the invention showing a section of a twin-wire zone with a forming cylinder as supporting element and with a formation box.

According to the invention, a wire part of a machine for the production of fibrous material webs includes two continuous wire belts which are guided together on a part of the periphery of the wire part and form a twin-wire zone. At least one supporting element is arranged in the region of the twin-wire zone. This element has a supporting surface, at least part of which supports the first wire belt on its inner surface and the second wire belt on its outer surface. This region is also called a supporting region. Furthermore, at least one formation box is provided, which is disposed within the second wire belt loop. The formation box is arranged in the supporting region and designed in such a way that, in the region of the inner surface of the second wire belt, in the formation box, the pressure values can be adjusted from a reduced pressure to an excess pressure. For this purpose, vacuum, air as medium, but also a liquid, can be applied to the formation box. The formation box extends in the direction of movement of the wire belt over at least a part of the supporting region. According to the difference between the pressure in the formation box and the atmosphere, and to the pressure relationships that exist on the supporting surface, control of the dewatering intensity and above all of the direction of dewatering is possible. Thus, active influence can be exerted on the distribution of the fiber fines and fillers.

A formation box that can be filled with liquid should preferably be fillable in such a way that the second wire belt is always wetted with liquid. This provides the advantage that the water separating from the wire is taken up immediately by the liquid and thus cannot have any adverse influence on sheet formation.

Preferably, means are provided that permit continuous adjustment of the pressure values in the formation box. Furthermore, the formation box can be subdivided in the direction of wire belt movement and/or along the width of the wire belt into a number of zones that can be controlled individually or in groups. This subdivision makes it possible to adjust the dewatering pressure locally to greatly varying edge conditions and/or operating conditions.

Preferably, a formation box can be combined with a pressure element arrangement. Thus, at least one pressure element is disposed in the formation box, applying pressure on the inner surface of the second wire belt at certain points independently of the pressure conditions in the formation box. The pressure points are distributed over the entire width of the wire belt. These pressure elements, which have already been disclosed in unpublished German patent application P 43 01 103, serve to intensify the dewatering. The combination of the formation box and the pressure element provides the advantage of the possibility of forcing the dewatering, realization of uniform distribution of fiber fines and fillers, avoidance of defects during sheet formation, for example, by individual liquid droplets, which, when they penetrate into the fibrous material suspension cause the occurrence of schlieren, as well as separation of fillers and fiber fines. When providing the appropriate elements, the direction of dewatering can be changed or adapted to altered operating conditions without any problems. The pressure elements can be mounted on a supporting frame in the formation box or they can extend beyond the width of the formation box and be located outside the box. The pressure elements can cover the entire wire width alone or together. They can be designed so that they are either rigid or bendable along the width of the wire belt. A design with zones of different bending stiffness can also be conceived. The latter provides the advantage that the pressure elements can smooth flocks that may be produced in the fibrous material suspension by local aggregation of the fibers. Preferably, the pressure elements are designed so that they give (i.e. flex) when pressure is applied and again this pressability can be controlled individually or in zones in the wire belt direction of movement and/or transversely to the wire belt direction of movement. The pressure values, that is, the pressure applied onto the inner surface of the second wire belt is preferably adjustable variably as a function of the time as well as alterably for each individual pressure element among the pressure elements arranged one after another in the direction of movement of the wire. This provides the advantage of rapid local adaptation to changing input conditions without any problems.

Preferably, the pressure elements are arranged in such a way that the forces used for pressing on the pressure elements and thus on the inner surface of the second wire belt are perpendicular to the wire belt. This provides the advantage that the full pressing force can be further conducted onto the wire belt. An arrangement of the pressure elements at an angle to the wire belts is also conceivable.

In order to achieve the effect of a positive or negative foil, the pressure elements can be supported so that they can be turned or tilted. Strips, blades, metering rods, or pressing shoes with convex, concave or flat pressing surface are suitable as pressing elements. Preferably, the pressing surface is made of highly wear-resistant material; ceramics are especially suitable.

The support of the pressure elements and application of pressure to them with pressing forces are accomplished with the aid of spring force or, for example, compressed air. In the latter case, there is a possibility to design the pressing element, for example, as disclosed in U.S. Pat. No. 5,078,835.

A structural unit made of the formation box and pressure elements which are active in the twin-wire zone in the region of a supporting surface provides the enormous advantage of achieving high intensity of dewatering and, at the same time, uniform web formation. Furthermore, the dewatering direction can also be decisively influenced.

Preferably, forming cylinders or belts are used as supporting elements. There are several possibilities for the design of the forming cylinder, which, in combination with the formation box or with the structural unit of the formation box and pressure elements, can fulfill various requirements for the fibrous material web to be formed. For example, the forming cylinder can have a closed surface, but it can also be provided with bores for the purpose of the application of suction. Furthermore, the forming cylinder can be designed with a storage volume or it can also have a zone that can be operated at a suction device or as a suction or blowing device. The following combinations are possible: (1) A formation box and a forming cylinder with a closed surface; (2) A formation box with pressure elements and a forming cylinder with a closed surface; (3) A formation box and a forming cylinder with a device for producing excess pressure or reduced pressure values; and (4) A formation box with pressure elements and a forming cylinder with a device for producing excess pressure or reduced pressure values.

In the first case (1), a reduced pressure is realized in the formation box on the inside surface of the second wire belt. For this purpose, reduced pressure can be applied to the formation box. This reduced pressure intensifies the dewatering of the fibrous material suspension guided between the two wire belts in the region where it loops around the forming cylinder in the direction of movement of the wire belt. The effect of reduced pressure is added to the action of wire tension with regard to intensification of the dewatering. As a result of wetting the second wire belt with liquid in the formation box, defects during sheet formation, which may occur on the wire surfaces due to the accumulation of liquid droplets can be avoided. In the second case (2), the effect of the pressure elements on the inner surface of the second wire belt is added to the effects discussed in the first case.

In the third (3) and fourth (4) cases, corresponding to the pressure value applied in the formation box, the pressure elements and the device on the forming cylinder, in addition to intensification of the dewatering active control of the dewatering direction and thus of the resulting formation of the fibrous material web is achieved. For example, if the formation box is disposed in the supporting region and if pressure is applied to it in such a way that pressure values in a reduced pressure range exist in the region of the inner surface of the second wire belt in the formation box, the device in the forming cylinder will also be operated as a suction device. For this purpose, vacuum can be applied to the formation box. In this case, with appropriate adjustment of the effects of the individual elements, completely uniform, two-sided dewatering, and thus uniform sheet formation can be achieved. However, in this case, the effect of the suction zone must be equal to the sum of the effects of the formation box, wire tension, and any pressure elements. Depending on the desired influence on the fibrous material suspension, these individual effects can be adjusted to one another differently.

If high intensity dewatering is desired in the direction of the first wire belt, that is, in the direction of the forming cylinder, for example, the formation box can be filled with a medium, in such a way that an excess pressure is produced on the inner surface of the second wire belt, while the device in the forming cylinder produces reduced pressure, that is, it operates as a suction zone. Another case is the intensification of dewatering in the direction of the second wire belt, that is, in the direction of the formation box. For this purpose, the device on the forming cylinder preferably produces an excess pressure. The device on the forming cylinder as well as the formation box, can be divided into zones in the direction of movement of the wire belt to which different pressure values can be applied. Furthermore, it is possible to provide means to create zones with different pressure values transversely to the direction of movement of the wire belt.

The mounting position of the formation box with respect to the mounting position of the forming cylinder is also essential for dewatering effectiveness because, when the formation box is filled with liquid, as a result of the different geodetic heights of the liquid in the formation box with respect to the arrangement on a forming cylinder, the different static pressures will produce a certain pressure profile in the looping-around region of the wire part. With regard to the mounting position of the forming cylinder, the formation box can be disposed both above as well as below the forming cylinder's axis of symmetry. The same applies to the pressure elements built into the formation box. The pressure elements can be displaced by themselves along the periphery of the forming cylinder relative to the formation box or they can be displaced together with the latter along the periphery of the forming cylinder. The pressure elements can also be arranged in the formation box in such a way that they act to seal the formation box to the atmosphere.

The determination of the length of the dewatering section on the forming cylinder in the direction of the movement of the wire belt and thus the length of the supporting region, as well as the establishment of the possible acting surface area for the pressure element and of the formation box, is accomplished as a function of the desired area weight. A longer dewatering section is necessary for high area weights, while for achieving lower area weight, small dewatering sections are needed.

In addition, before entering the supporting region on the forming cylinder and/or after leaving the supporting region on the forming cylinder, additional pressure elements can be provided on the inner surfaces of the wire belts. These serve predominantly for supporting the wire belts in the region of the twin-wire zone. The additional pressure elements can be inserted individually but also in a common arrangement with the pressure elements provided in the supporting region. In the latter case, the formation box extends preferably beyond the supporting region and the pressure elements in the supporting region as well as the additional pressure elements are disposed in the formation box.

The use of a belt as a supporting element is also possible. A continuous belt can be designed so that it is permeable to water or impermeable to water, depending on the desired direction of dewatering. The arrangement of the formation box is accomplished analogously to the arrangement on a forming cylinder. Here, too, it is possible to integrate additional pressure elements in the formation box.

It is also possible to design the forming cylinder with a non-rigid surface. For this purpose, a belt is supported by a plurality of guide elements, which are mounted on a central frame. Such an arrangement provides the advantage of the possibility of avoiding the supporting surface in case of any disturbances in the form of very high local variations in the concentration of the fibrous material suspension.

The arrangement of a supporting element/formation box according to the invention can be followed by other dewatering units of different design. For example, conventional dewatering units can be used in the form of several non-rigidly supported strips which lie against the inside surface of one of the two wire belts and are assigned to the gap between the strips rigidly supported on the other wire belt. Several supporting elements/formation box units can also be provided within a twin-wire zone. The designs of the wire parts, especially in the region of the twin-wire zones, depend on the corresponding requirements in each individual case. The arrangement of the supporting element/formation box and of any formation boxes with pressure elements can be arranged in any arbitrary mounting position in a wire part. It is possible to use the arrangement in a gap former or in a hybrid former. In the case of the gap former, it is possible to introduce the fibrous material suspension jet directly into the formation box between the two wire belts.

The invention is further described herein with the aid of the drawings. FIG. 1*a* shows a section from a twin-wire zone of a wire part of a machine for the production of a continuous fibrous material web. A twin-wire zone 1 is formed by common guidance of two continuous wire belts—a first continuous wire belt 2 and a second continuous wire belt 3—by guiding them together along a certain section of the machine. A supporting body in the form of a forming cylinder 4 is provided in the twin-wire zone 1. The forming cylinder 4 is looped around on a part of its periphery by the two continuous wire belts 2 and 3. The forming cylinder 4 has a supporting surface 5 which supports the inner surface 6 of the first continuous wire belt 2 and the outer surface 7 of the second continuous wire belt 3 in the region where the wire belts loop around the forming cylinder 4. The region, where a part of the supporting surface 5 of the forming cylinder 4 supports the first wire belt 2 on its inner surface 6 and the second wire belt 3 on its outer surface 7 is designated as a supporting region I. Accordingly, at least one formation box 8 is provided in the supporting region I. The formation box 8 is disposed and designed in the supporting region I in such a way that pressure values are produced in the formation box 8 which become active in the region of the inner surface 9 of the second wire belt 3. These pressure values may vary between an excess pressure and a reduced pressure.

In this case (FIG. 1*a*), vacuum is applied to the formation box 8. Means are provided for controlling the pressure values in the formation box 8. For example, as shown in FIG. 1*a*, such means can be a valve 50. Inlet lines, among others, for the medium that is to fill the formation box are not shown in the individual figures for the sake of greater clarity. Here, the formation box 8 becomes active only in the supporting region in the region of the inner surface of the second wire belt 3. The design of the formation box 8 is such that outer walls 51 and 52 of the box 8 lie tightly against the inner surface 9 of the second wire belt 3.

A number of variations can be considered for the design and execution of the forming cylinder 4. For example, as shown in FIG. 1*a*, the forming cylinder 4 can have a closed surface 5, which also forms the supporting surface. However, it is also possible to design the forming cylinder 4 with a surface 5 which is not closed and to provide the surface 5 with a plurality of bores, for example, for the purpose of applying suction if two-sided dewatering is desired. Looking in the direction of movement of the wire belt, the device for applying suction can be constructed in one zone, but it can also have several zones. Furthermore, it is possible to design this device in such a way that a both reduced pressure or an excess pressure can be applied onto the wire belts and thus onto the fibrous material suspension 10 guided between the wire belts.

A dewatering element 11, for example, in the form of a forming shoe, is disposed after (i.e. downstream) the forming cylinder 4 in the direction of the wire belt movement. In the region where the two wire belts 2 and 3 loop around the forming cylinder 4, the fibrous material suspension 10 guided between the two wire belts 2 and 3 is dewatered as a result of the tensions on the wire belts when guided over a curved surface.

As a result of application of vacuum to the formation box 8, the inner surface 9 of the wire belt 3 is exposed to almost equivalent pressure conditions in the supporting region I in the direction of movement of the wire belt. This makes it possible to provide uniform dewatering of the fibrous material suspension 10 guided between the two wire belts 2 and 3.

Figure 1B:
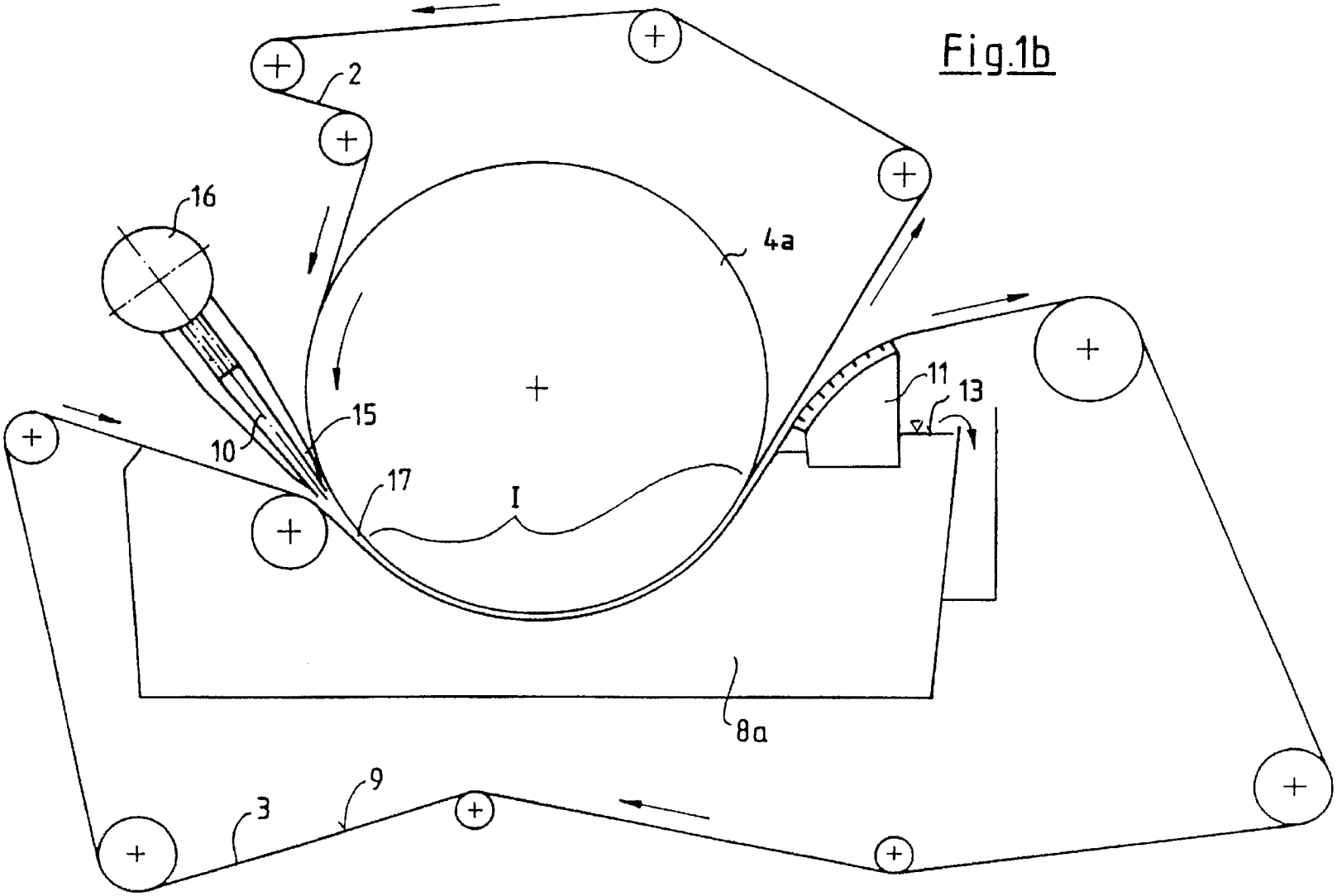
FIG. 1*b* is a partially schematic sectional view of a second embodiment of a wire part according to the invention showing a section of a twin-wire zone with a forming cylinder as supporting element and with a formation box.

FIG. 1*b* shows an arrangement according to FIG. 1*a*, but here the two continuous wire belts 2 and 3 run together only at the periphery 5 of the forming cylinder 4*a* and form here a wedge-shaped inlet gap 15 where the fibrous material suspension 10 can be injected. A headbox 16 is assigned to this wedge-shaped inlet gap 15. Otherwise the basic construction of the apparatus of FIG. 1*b* corresponds to that already described in FIG. 1*a*. Therefore, the same reference symbols are used for the same elements of these figures and also FIGS. 2–9.

In contrast to FIG. 1*a*, in FIG. 1*b* the fibrous material suspension is sprayed directly between the two wire belts 2 and 3 in the region of an inlet 17 into the supporting region I. The formation box 8*a* can be filled completely with liquid, preferably with water. The formation box 8*a* is arranged so that the liquid contained in it is effective in a region which extends beyond the supporting region I. The fibrous material suspension 10 is sprayed directly from the headbox 16 into the liquid in the formation box 8*a* between the two continuous wire belts 2 and 3 and then it is dewatered in the supporting region I due to the tension in the wire belts 2 and 3 and due to the pressure difference between the forming cylinder 4*a* and the formation box 8*a*.

The liquid-filled formation box 8*a* is disposed in a part of the supporting region I in such a way that the inside surface 9 of the second wire belt 3 is exposed to a certain pressure action due to the pressure existing in the liquid. In the embodiment shown in FIG. 1*b*, this pressure depends on the geodetic height of the liquid, if there is no other effect from the outside. However, as shown in FIG. 1*a*, it is possible to control this pressure. Due to the horizontal arrangement of the formation box 8*a* in the mounting position, relatively uniform dewatering of the fibrous material suspension 10 can be achieved in the supporting region I when the suspension goes through the supporting region I. The effect of the formation box 8*a* can be varied by providing an overflow edge 13, the height of which is adjustable, and the length of the formation box 8*a* can be varied along the length of supporting region I.

The embodiment represented in FIGS. 1*a* and 1*b* with horizontal mounting position can also be used for an inclined or vertical mounting position. At the end, or at an outlet from the supporting region, the formation box can also be designed so that it is disposed tightly against the inner surface of the second wire belt 3.

If the forming cylinder 4 or 4*a* shown in FIGS. 1*a* and 1*b* is not built with a closed surface and, furthermore, if it has a device for applying suction or excess pressure, at least in the supporting region I, it is possible to control two-sided dewatering of the fibrous material suspension 10 directly between the two wire belts 2 and 3. In addition to controlling the intensity of dewatering, one can also actively influence the filler distribution in the fibrous material suspension. The following possibilities can be used in the combination of a formation box and a forming cylinder design. These permit active adaptation to the most varied requirements with regard to the fibrous material web to be produced. The following combinations are possible:

In FIG. 1*a*: (1) A formation box with reduced pressure and a forming cylinder with a closed surface or storage volume; and (2) A formation box with reduced pressure and a forming cylinder with a device for producing reduced pressure or excess pressure.

In FIG. 1*b*: (1) A liquid-filled formation box on a forming cylinder with a closed surface; (2) A liquid-filled formation box with the possibility of adjusting the pressure and a forming cylinder with a closed surface; (3) A liquid-filled formation box with a forming cylinder having a device which is active in the supporting region for producing a reduced or excess pressure; and (4) A formation box that can be filled with liquid, with the possibility of controlling the pressure values and a forming cylinder with a controllable device for producing excess pressure or reduced pressure values.

In the first case (1), the dewatering pressure results from the wire tensions created as a result of looping of the wire belts around the forming cylinder 4 as well as, in the case of the liquid-filled formation box, as a result of the geodetic height of the liquid level in the formation box.

In the other cases, the production of excess pressure or reduced pressure at the forming cylinder must also be taken into consideration.

In the figures shown, with the forming cylinder below the axis of symmetry of the formation box, the formation box is arranged in the horizontal mounting position. However, it is possible to displace the box along the periphery of the forming cylinder in such a way that, due to the dependence of the pressure on the height at the periphery of the forming cylinder in case of a liquid-filled formation box, a uniform increase of the pressure applied to the inside surface of the second wire belt will be achieved in the direction of movement of the wire belt.

In FIG. 1*b*, the unit of the forming cylinder 4*a* and the formation box 8*a* is followed by a conventional dewatering element 11 in the form of a forming shoe. In the embodiment shown in FIG. 1*b*, the element 11 is disposed in the formation box 8*a*, which extends beyond the supporting region I.

Figure 2:
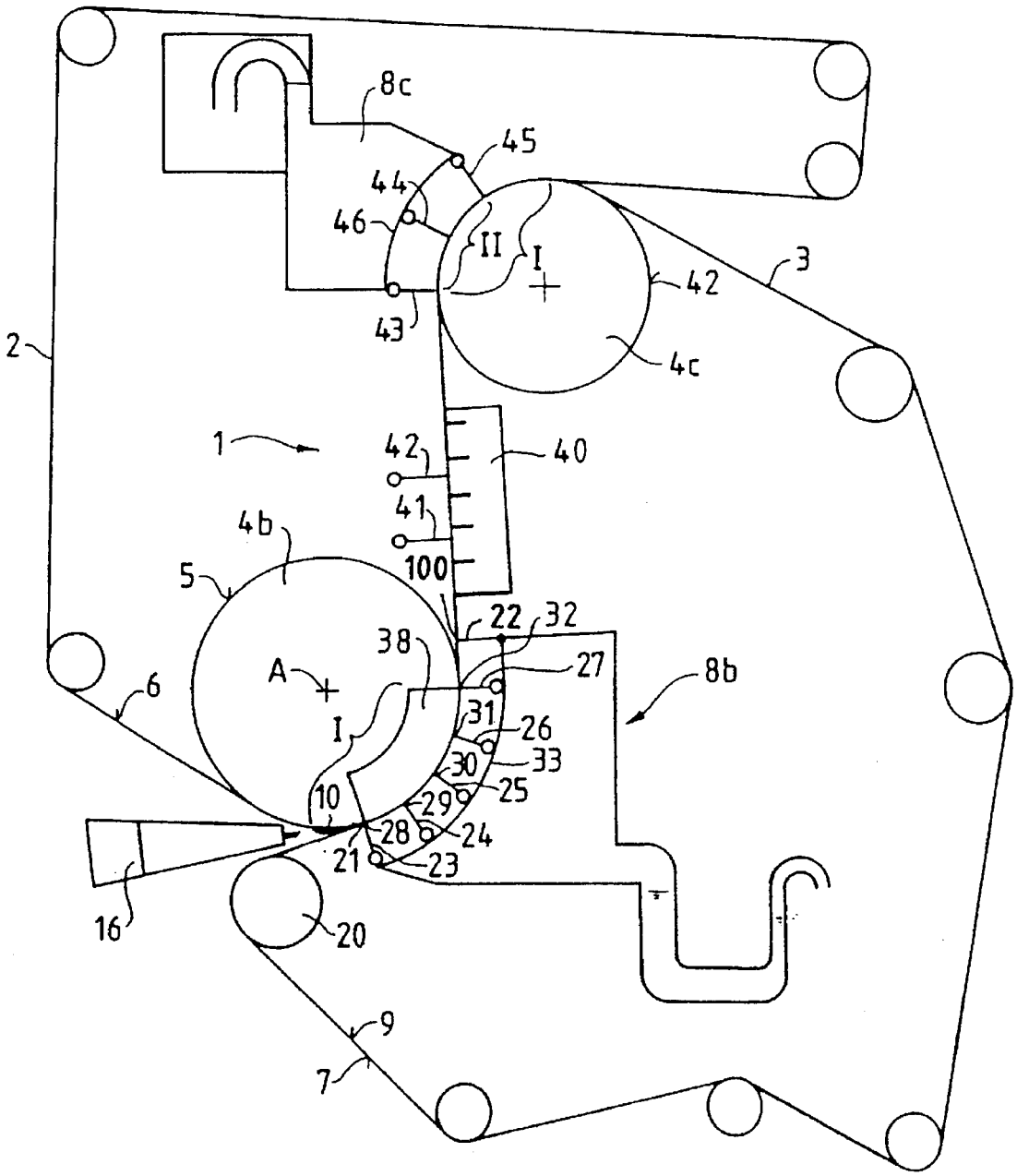
FIG. 2 is a partially schematic sectional view of a third embodiment of a wire part according to the invention showing a twin-wire zone of a wire part of a papermaking machine with a forming cylinder as supporting element and a formation cylinder with additional pressure elements disposed in the supporting region.

FIG. 2 shows a section of a wire part of a papermaking machine, especially a twin-wire zone 1. A continuous first wire belt 2 and a continuous second wire belt 3 are combined together along a certain section. This region is called the twin-wire zone 1. Both the wire belts 2 and 3 run together in the immediate neighborhood of a headbox 16 through a roll 20 and a cylinder 4*b* respectively, which is designed as a forming cylinder, in such a way that the two wire belts 2 and 3 form a wedge-shaped inlet gap 21 for the fibrous material suspension 10 at the beginning of the twin-wire zone 1.

The forming cylinder 4*b* is disposed within the continuous wire belt 2 and the device—a formation box 8*b* as described in claim 1, is within the continuous wire belt 3. The forming cylinder 4*b* supports with its surface, which simultaneously functions as a supporting surface 5, for the inner surface 6 of the first continuous wire belt 2 and the outer surface 7 of the second continuous wire belt 3 in the region where the two wire belts 2 and 3 loop around the forming cylinder 4*b*. This looping-around region forms the supporting region I. The formation box 8*b* is disposed within the second continuous wire belt 3 in the supporting region. Its effect extends, in the example shown here, from the region of an inlet 21 in the supporting region to beyond the supporting region I. The formation box 8*b* is designed in such a way that it can be filled with a medium so that, in the region of the inner surface 9 of the second continuous wire belt 3, pressure values can be adjusted in the formation box 8*b* from a reduced pressure to an excess pressure. Furthermore, at least one pressure element, but in the example shown, a number or pressure elements 23, 24, 25, 26, 27, and 22 are disposed in the formation box 8*b* which apply pressure onto the inner surface 9 of the second wire belt 3 at certain points 28, 29, 30, 31, 32, and 100, respectively, independently of the pressure relationships that exist in the formation box 8*b*. The pressure points are disposed over the entire width of the wire belt, that is, transversely to the direction of movement of the wire belt. The pressure elements can be designed in a great variety of ways. For reasons of clarity, these are shown in the figures in a very simplified and schematic way. The elements shown in the drawing generally represent pressure elements. The pressing exerted by the pressure elements can be varied either continuously or in steps. Possible embodiments are shown in FIGS. 3*a* to 3*d* and therefore they will not be discussed further with respect to FIG. 2. For example, the pressure elements can be mounted on a supporting frame 33, which is also disposed in the formation box 8*b*. The supporting frame 33 is designed in such a way that it exerts no influence or only very little influence on the pressure conditions in the formation box 8*b*. The task of the pressure elements is to produce line-like or point-like loads or area-type loads on the wire belt 3, leading to turbulences in the fibrous material suspension 10 between the two wire belts 2 and 3, thus contributing to the prevention of flock formation and forcing dewatering additionally to the existing dewatering pressure due to tension of the wires. The direction of the pressure is preferably chosen to be perpendicular, that is, radial, to a forming cylinder axis A. Other arrangements are also conceivable, but the force component acting in the radial direction to the forming cylinder axis A should not be too small. The supporting surface 5 of the forming cylinder 4*b* is designed so that it is essentially rigid in the direction in which the pressure acts, that is, it cannot escape in the direction in which the pressure acts.

The pressure elements 22–27 shown in FIG. 2 can extend alone or with other pressure elements over the width of the wire belt, that is, transversely to the direction of movement of the wire belt.

Figure 3A:
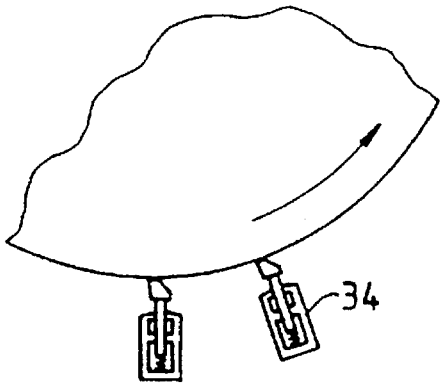
FIG. 3*a* is an enlarged and partially schematic sectional view of a portion of a wire part according to the invention showing pressure elements of the invention.
Figure 3C:
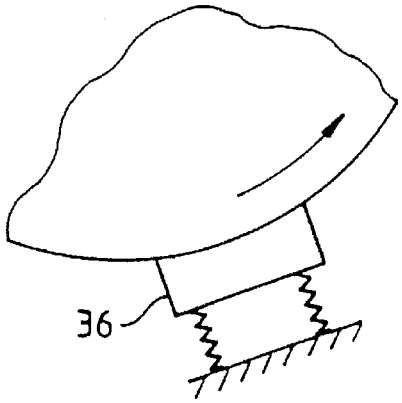
FIG. 3*c* is an enlarged and partially schematic sectional view of a portion of a wire part according to the invention showing a third embodiment of a pressure element of the invention.
Figure 3D:
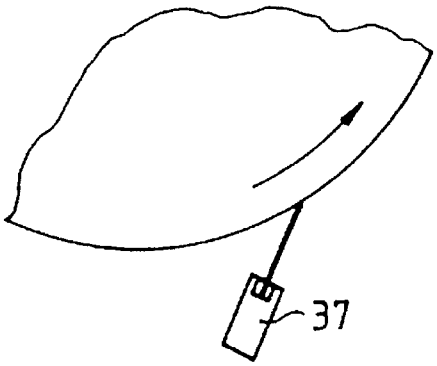
FIG. 3*d* is an enlarged and partially schematic sectional view of a portion of a wire part according to the invention showing a fourth embodiment of a pressure element of the invention.
Figure 3B:
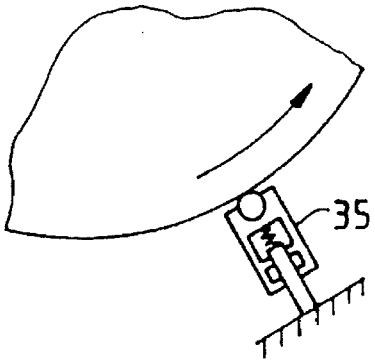
FIG. 3*b* is an enlarged and partially schematic sectional view of a portion of a wire part according to the invention showing a second embodiment of a pressure element of the invention.

The pressure elements can be designed in different ways as shown in FIGS. 3*a*–3*d*. The non-rigidly supported pressure elements can be designed preferably as disclosed in U.S. Pat. No. 5,078,835. FIG. 3*a* shows a pressure element embodiment in the form of strips 34, while FIG. 3*b* shows the possibility of using a pressure element in the form of a roll, in which case the pressure element is preferably a metering rod 35. FIG. 3*c* shows an embodiment having a pressing shoe with a concave pressing surface 36. FIG. 3*d* shows the use of a pressing blade 37. The pressure elements can be non-rigidly supported. In that case, they transmit the forces which can be produced, for example, by springs, but also pneumatically, onto the inner surface 9 of the wire belt 3 and thus produce point-like or line-like loads on the inner surface of the wire belt, depending on the type of pressure element used, leading to turbulences in the fibrous material suspension between the two wire belts. The initiated pulsations prevent flock formation and more water is separated as a result of the applied pressure and the related change in wire tension. With reference to FIG. 2, the part of the mantle surface 5 of the forming cylinder 4*b* extending over the entire width of the wire in the looping-around region functions as a pressing-force opposing surface. The magnitude of the introduced forces that lead to a certain applied pressure through the action of the individual pressure elements 23 to 27 on the inner surface 9 of the wire belt 3 is variable and does not have to be kept constant over the entire looping-around region. Due to the design and arrangement of the pressure elements, the forces act so that there remain areas in the looping-around region of the wire belts with the forming cylinder 4*b* which are not influenced by the pressure elements. These pressure-free regions and the non-rigid support of the pressure elements are necessary to avoid agglomeration of the fibers.

The pressure elements can be controlled individually or in groups in the direction of movement of the wire belt and along the width of the wire belt.

Preferably, pressure element force is applied radially to the forming cylinder axis; however, it is also possible to apply the force in such a way that only a component of the force acts radially to the forming cylinder axis A. This possibility will be described later in FIG. 4.

In the embodiment shown if FIG. 2, vacuum can be applied to the formation box 8*b*. Here, the pressure elements are disposed in the formation box 8*b*, whereby the two outer pressure elements, 23 and 22, simultaneously form the closure of the formation box. The forming cylinder 4*b* is equipped with a device 38 for producing excess pressure or reduced pressure. If uniform dewatering on both sides of a web is desired, the effects of the device 38, as well as the sum of the effect of wire tension and centrifugal forces, of the formation box and pressure elements, must be in equilibrium. If it is desired to intensify the dewatering in the direction of the second wire belt 3, the device 38 can produce an excess pressure against the pressure values that exist on the inner surface of the wire belt 3. In FIG. 2, the position of the pressure element 27 accidentally coincides with the end of the device 38 for producing reduced or excess pressure. Further dewatering elements can be connected after the arrangement of the forming cylinder 4*b* and the formation box 8*b* with pressure elements. In FIG. 2, in the twin-wire zone, another conventional dewatering element is provided in the form of a wire suction box 40.

Pressure elements in the form of strips, here 41 and 42, which act on the inner surface 6 of the first wire belt 2 are assigned to and in cooperation with the wire suction box 40, which is disposed within the wire belt 3 and acts on the inner surface 9 of the wire belt 3. The strips 41 and 42 are disposed opposite the strips on the wire suction box 40, not shown here individually, displaced so that they face the gaps formed between the strips on the wire suction box 40.

In the direction of movement of the wire, another dewatering element in the form of a cylinder 4*c* is disposed after (i.e. downstream) the conventional dewatering element 40. The two continuous wire belts 2 and 3 loop around the cylinder 4*c* on a part of the periphery formed by a surface 42. This part is also called the supporting region and this is also designated with the letter "T". In this region I, the surface 42 supports the inner surface of the wire belt 3 and the outer surface 5 of the wire belt 2. A formation box 8*c* is assigned to the cylinder 4*c*. This box is preferably filled with liquid. In addition, pressure elements, for example, elements 43, 44 and 45, are provided in the formation box 8*c*. The formation box 8*c* and the pressure elements 43–45 are only active in a partial region II of the supporting region I on the inner surface 6 of the first wire belt 2.

When the formation box 8*c* is completely filled with water, as a result of this, pressure values up and into the excess pressure region can be applied on the inner surface 6 of the first wire belt 2. The disposal of the formation box 8*c* opposite the cylinder 4*c* in a mounting position which is almost in the vertical direction, due to the dependence of the pressure on the height in the direction of movement of the wire belt, makes it possible to decrease the pressure value existing on the inner surface 6 of the wire belt 2 in the looping-around region, that is, in the partial region II. Thus, it is already possible, by the arrangement of a formation box that can be filled with liquid, to produce a certain pressure profile in the supporting region, without any additional influence from the outside. This can be enhanced further by additional measures, which are not listed here in detail.

The pressure elements can be designed analogously to that already described for the pressure elements 22–27, that is, as shown in FIGS. 3*a* to 3*d*. The pressure elements are mounted on a supporting frame 46, but the pressure that can be applied through the pressure elements can be controlled independently of the pressure relationships in the formation box. The supporting frame 46 can be mounted in the formation box, but it is also possible, although not shown here, to extend the frame 46 beyond the formation box and mount it outside the formation box. In the embodiment shown, the pressure elements 43 and 45 simultaneously serve to seal the formation box 8*c* on the inner surface 6 of the wire belt 2. In the embodiment shown in FIG. 2, the range of action of the formation box and of the pressure element do not extend beyond the supporting region I.

Corresponding to the desired dewatering action, the cylinder 4*c* can be designed with a closed surface, open surface, with suction or without suction. However, it is recommended to design the cylinder 4*c* with suction because of the arrangement of the formation box 8*c* and because of filling with liquid, as a result of which excess pressure values active on the inner surface 6 of the wire belt 2, thus, enhanced dewatering, is caused in the direction of the cylinder 4*c*. Here, too, it must be observed that, in order to produce a desired dewatering result, the actions of the formation box 8*c*, the cylinder 4*c* and the curved wire guidance along the surface 42 of the cylinder 4*c* must always be considered in their entirety.

The embodiment of the invention shown in FIG. 2 illustrates a multiple cylinder/formation box arrangement according to the invention. The design of the cylinder/formation box arrangement is adapted to the requirements of the individual case. Here, too, it is possible to include dewatering elements other than the wire suction box 40.

Figure 4:
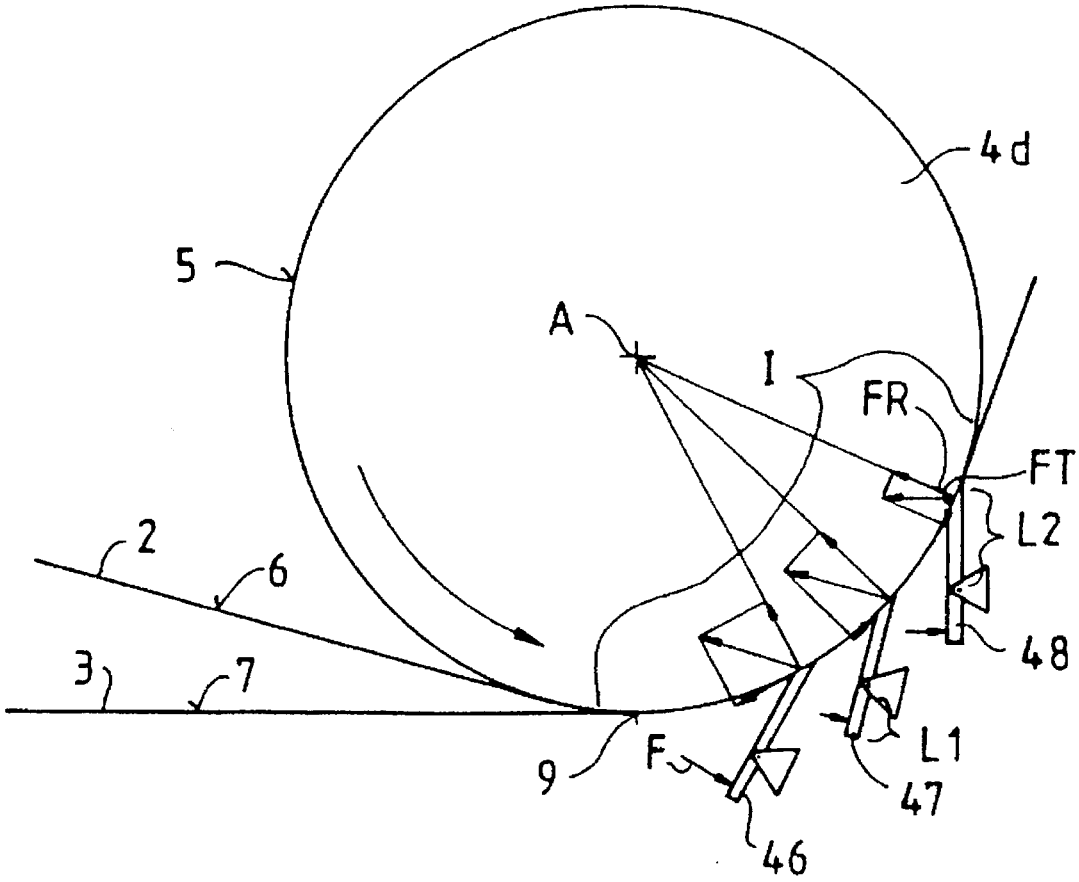
FIG. 4 is an enlarged and partially schematic sectional view of a portion of a wire part according to the invention showing a mounting of pressure elements of the invention.

FIG. 4 shows the possibility of applying forces by the pressure elements on the inner surface of one of the two wire belts and thus also on the fibrous material suspension guided between the two wire belts, in which only a component of the force acts radially to a cylinder axis A. In order to illustrate this, only one forming cylinder 4*d* as well as two continuous wire belts 2 and 3 are shown, which loop around the forming cylinder 4*d* on a part of the cylinder periphery 5. This part is also designated as a supporting region and is noted here with an "I". In this supporting region I, the inner surface 6 of the first wire belt 2 and the outer surface 7 of the second wire belt 3 are supported. In the supporting region I, non-rigidly supported pressure elements act, here pressure elements 46, 47 and 48, which are designed as rocker arms. The mounting of the pressure elements is not directly at their ends, but in a region along their length. Between the ends, the pressure elements are connected to a fixed support through a link. Thus, two lever arms, L1 and L2, are produced. A force produced, for example, by springs, acts at the end of the lever arm L1, which does not lie against the wire inner surface 9. Due to the lever principle, an equal opposing force acts at the end of the other lever arm L2. A component FR of this opposing force, which acts radially to the forming cylinder axis A, is the pressing force which acts directly on the wire inner surface 9. Here, too, the action of the pressure elements 46, 47 and 48 leads to an increase of the dewatering already produced by the rotation as a result of centrifugal forces.

Figure 5:
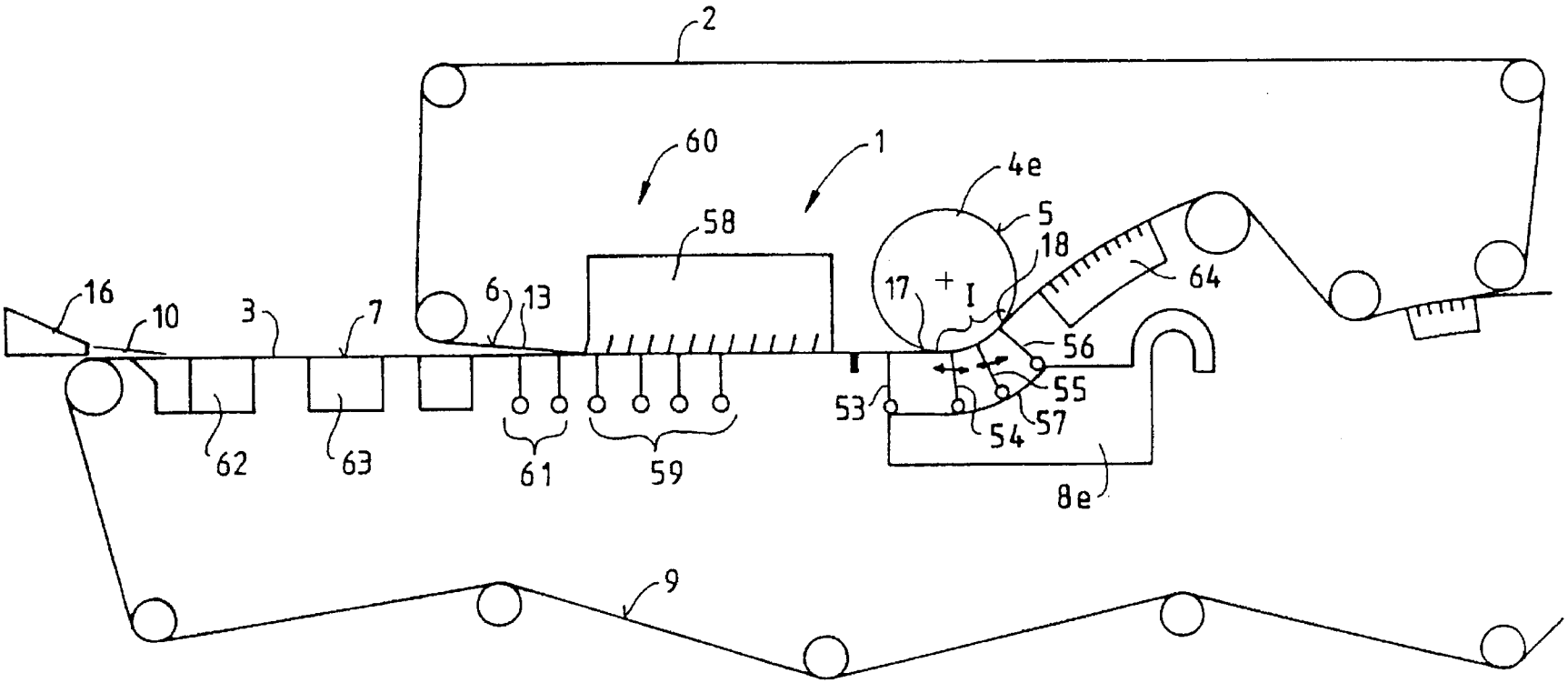
FIG. 5 is a partially schematic sectional view of a fourth embodiment of a wire part according to the invention showing an arrangement of a supporting element/formation box with pressure elements in a hybrid former.

FIG. 5 illustrates a possibility of including a forming cylinder/formation box arrangement according to the invention in a hybrid former. A continuous wire belt 2 and a continuous wire belt 3 are guided together on a part of its periphery. In this region, they form a twin-wire zone 1. A forming cylinder 4*e* is provided in the twin-wire zone as a dewatering element. The cylinder 4*e* is disposed within the continuous wire belt 2 and supports the inner surface 6 of the continuous wire belt 2 and the outer surface 7 of the continuous wire belt 3 in a region I, which is formed by looping of the two wire belts around the surface 5 of the forming cylinder 4*e*. As already described in FIGS. 1 and 2, a formation box 8*e* is assigned to the forming cylinder 4*e*. This formation box is assigned to the forming cylinder 4*e* in such a way that, in the region of the inner surface 9 of the wire belt 3, pressure values between a reduced pressure and an excess pressure can be achieved. In order to produce reduced pressure values, preferably, vacuum is applied to the formation box 8*e*, while it can be filled completely with a liquid in case of excess pressure values. In the design shown, the formation box is extended beyond the supporting region I. Pressure elements 53, 54, 55 and 56 are disposed in the formation box. These are mounted here, too, on a common supporting frame 57, which, again, can be mounted outside the formation box 8*e* or in the formation box 8*e*. Pressure elements 53 and 56 form the sideways delineation of the formation box to the inner surface 9 of the wire belt 3. The pressure elements can be designed here, too, as described in FIGS. 2 and 3. The pressure elements apply pressure onto the inner surface of the wire belt 3 independently of the pressure values in the formation box 8*e*. The design of the forming cylinder (with suction, without suction) and the filling of the formation box (vacuum, liquid) and the control or control system of pressure values in the formation box 8*e* is carried out corresponding to the individual case, that is, corresponding to the desired dewatering direction and dewatering intensity. In the example shown, the formation box 8*e* is filled with liquid. If needed, pressure elements 54 and 55 can be displaced along the periphery of the forming cylinder 4*e* (shown by double arrows).

Here, the pressure element 53 is the only pressure element acting before (i.e. upstream) an inlet 17 of the two wire belts at the forming cylinder on the inner surface 9 of the second wire belt 3. The pressure element 53 is directly responsible for guiding the two wire belts. In the embodiment shown in FIG. 5, this pressure element 53 is mounted on the common supporting frame 57, with the pressure elements 54 to 56 that act in the supporting region, and is disposed in the formation box 8*e*. The construction of the frame 57 is very simple and saves individual mounting of the pressure element 53 before the inlet 17 on the forming cylinder. However, it is also possible to mount the pressure element 53 separately before (upstream) the inlet 17. Furthermore, analogous to this, it is possible to provide not only one pressure element before the inlet, but a number of them. Furthermore, although not shown here, pressure elements can also be disposed behind (i.e. downstream) the outlet 18 of the two wire belts from the supporting region I. Here, an individual pressure element can be provided or, again, a number of them.

Analogously to what is described herein for the pressure element 53, pressure elements downstream of the outlet 18 can be mounted together with the pressure elements in the formation box or can be mounted separately.

FIG. 5 shows a conventional dewatering element 58 in the form of an upper wire suction box with strips disposed on the bottom side and can be connected before (i.e. upstream) the arrangement of the forming cylinder 4*e* and the formation box 8*e* with pressure elements, in the twin-wire region. Pressure elements, which are designated in their entirety with the reference numeral 59, which act on the inner surface 9 of the second wire belt 3, are disposed opposite the strips of the upper wire suction box, displaced to the gaps of the upper wire suction box strips. Furthermore, additional guide strips designated as 61 can be connected before (i.e. upstream) this dewatering unit, which is designated here with a reference numeral 60.

The continuous wire belt 3 is designed in such a way that, before (i.e. upstream) the inlet 13 into the twin-wire zone, it forms a Fourdrinier wire arrangement. An element for introduction of the fibrous material suspension 10 in the form of a headbox 16 is assigned to this Fourdrinier wire arrangement. Here, the fibrous material suspension is applied directly onto the outside surface 7 of the continuous wire belt 3 and is preliminarily dewatered with the aid of individual dewatering elements 62 and 63, which are not described here in more detail, before (i.e. upstream) the inlet into the twin-wire zone. The dewatering in the twin-wire zone is accomplished via a dewatering unit 60 and the arrangement of the forming cylinder 4*e* and the formation box 8*e*. The arrangement of the forming cylinder 4*e* and the formation box can again be followed by another conventional dewatering element in the form of a forming shoe 64. The design and combination of the individual dewatering elements with the forming cylinder/formation box arrangement is accomplished corresponding to the requirements of the individual case and lies within the decision of the expert. Overall, however, one can consider a number of possibilities which can differ in the nature of the dewatering elements that can be combined with the forming cylinder/formation box arrangement and in the number of possible dewatering elements.

Figure 6:
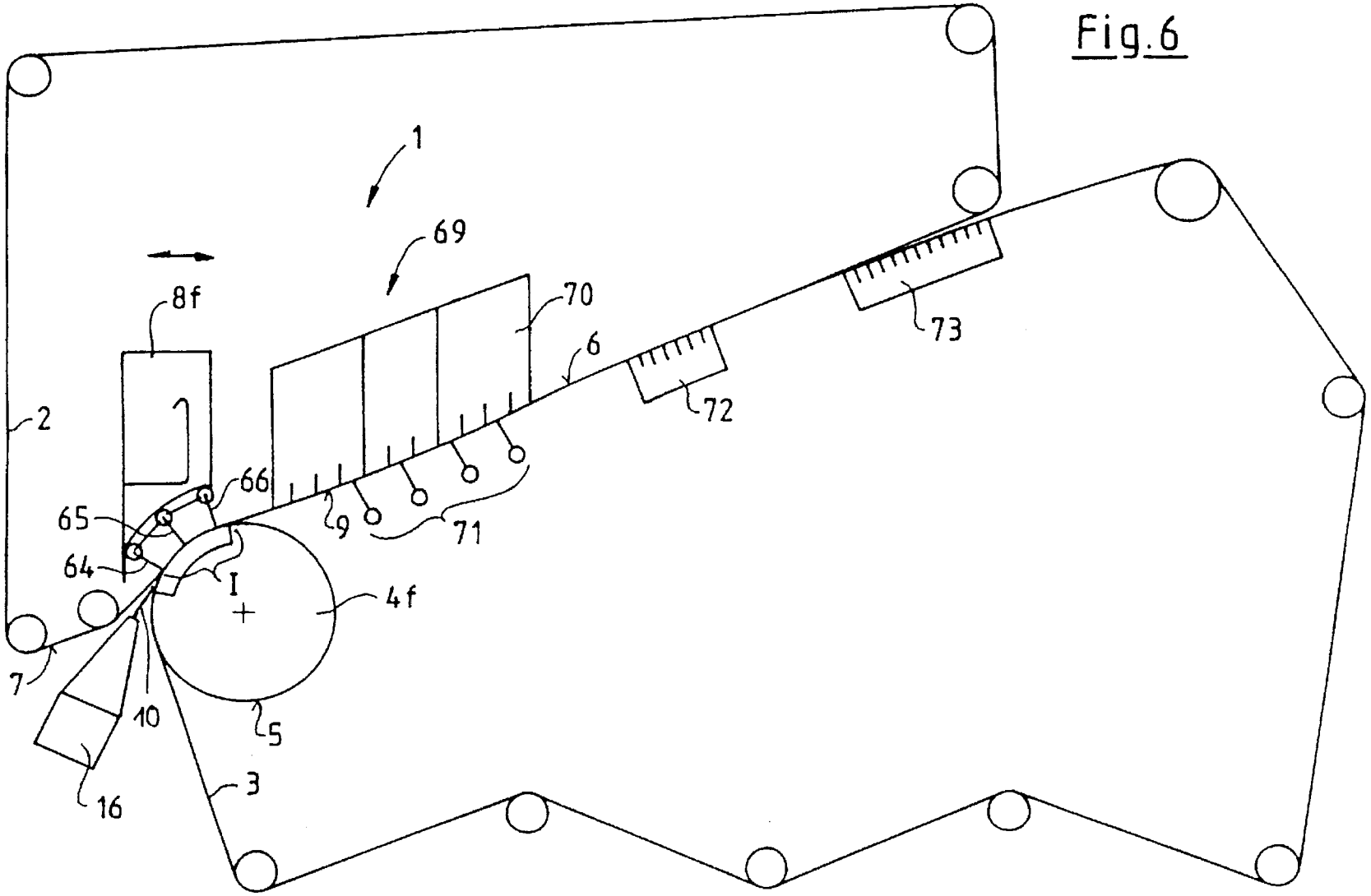
FIG. 6 is a partially schematic sectional view of a fifth embodiment of a wire part according to the invention showing an arrangement of a supporting element/formation box in a diagonal gap former.

FIG. 6 shows the possibility of using an arrangement of a forming cylinder/formation box in a diagonal gap former. This shows a possibility for achieving webs with low and high area weights without extensive restructuring. Here, too, the two continuous wire belts 2 and 3 form a twin-wire zone 1 with one another. The arrangement of a forming cylinder 4*f* and a formation box 8*f* is at the beginning of the twin-wire zone shown in FIG. 6. The supporting region I, in which the surface 5 [of the cylinder], the inner surface 9 of the second wire belt 3 and the outer surface of the first wire belt 2 is supported, is disposed directly after (i.e. downstream) the headbox 16. In contrast to the embodiment described with respect to FIG. 1*b*, pressure elements 64–66 are provided in the formation box 8*f*. These elements are mounted in the formation box 8*f*, whereby the outer walls of the formation box are disposed tightly against the inner surface 6 of the first wire belt. The formation box 8*f* does not extend beyond the supporting region and is preferably filled with a liquid.

Pressure elements 64 to 66 provide not only improvement in web formation, but also improvement of the web transverse profile with a large area weight spectrum. Here, the formation box 8*f* can be displaced together with the pressure elements 64–66 along the periphery of the forming cylinder 4*f*, when necessary.

The arrangement of a formation box/forming cylinder can be followed by various conventional dewatering elements, for example, a dewatering unit 69, which includes an upper wire suction box 70 with strips that become active on the inner surface 6 of the first wire belt (these strips not shown individually) and nonrigid pressure elements 71 which become active on the inner surface 9 of the second wire belt 3. Further dewatering elements can follow this arrangement in the form of forming shoes, designated 72 and 73 in FIG. 6.

Figure 7:
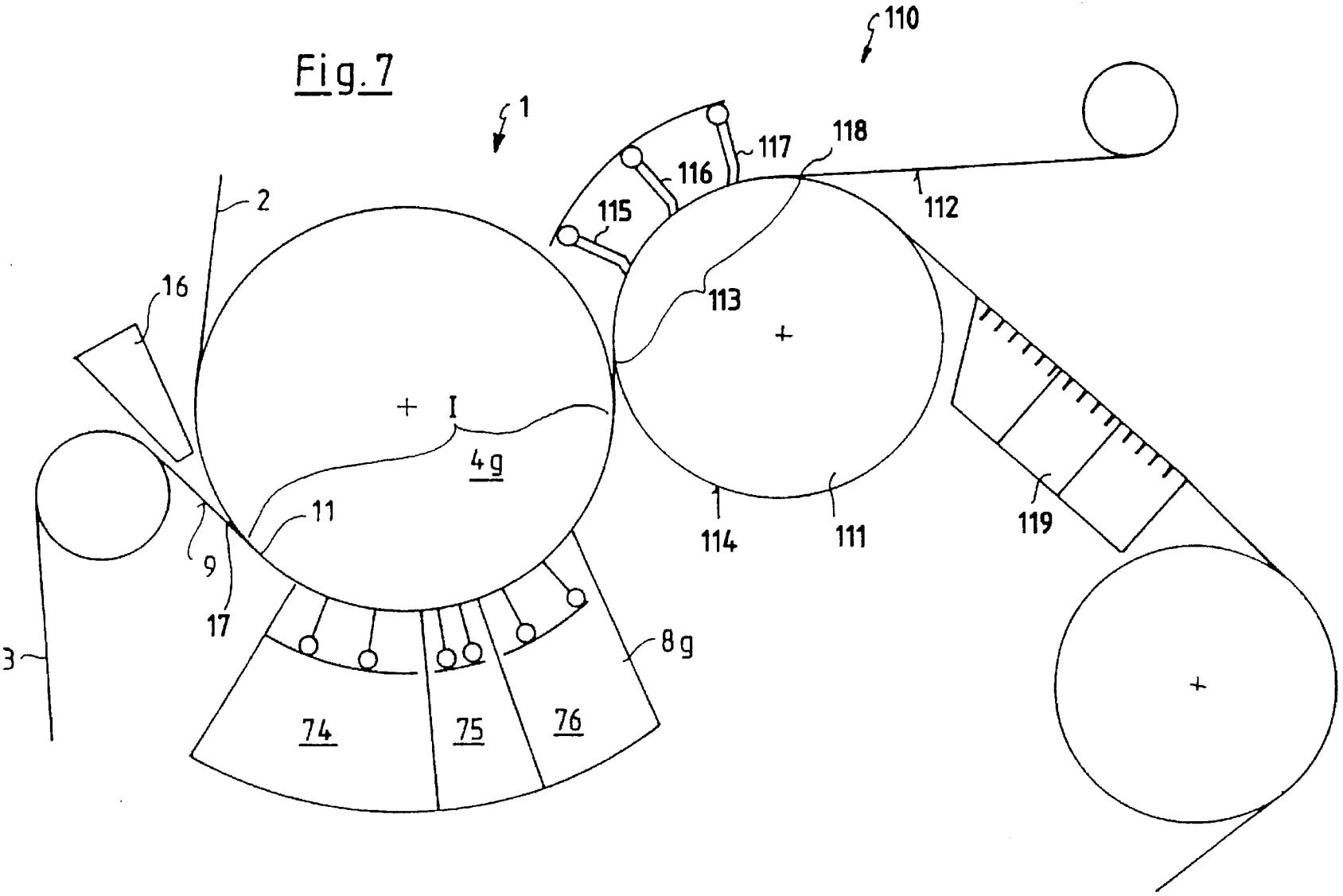
FIG. 7 is a partially schematic sectional view of a sixth embodiment of a wire part according to the invention showing an arrangement of a supporting element/formation box in a gap former.

FIG. 7 shows an arrangement of a forming cylinder/formation box with pressure elements in another former where the formation box can be subdivided into individual pressure zones in the direction of movement of the wire belt. Here, the former is shown in a horizontally mounted position but preferably it is mounted vertically. As in the previous figures, the same reference numbers are used for the elements in the region of the twin-wire zone and in the forming cylinder/formation box arrangement.

The twin-wire zone 1 is composed of two continuous wire belts 2 and 3. The two continuous wire belts 2 and 3 loop around the surface 5 of the forming cylinder 4*g* on a part of its periphery. This region, designated with an "I", is also called a supporting region. An inlet 17 of the two wire belts 2 and 3 in the supporting zone I also defines the beginning of the twin-wire zone. There is a headbox 16 directly before (i.e. upstream) the inlet 17. A forming cylinder is assigned to a formation box 8*g* in such a way that it can produce pressure values in the range from a reduced pressure to an excess pressure in the supporting region I on the inner surface 9 of the wire belt 3. In addition, pressure elements are assigned to the formation box 8*g*. The formation box 8 is subdivided into several zones in the direction of movement of the wire belt. These are designated here by the numerals 74, 75, and 76. Each individual zone can be controlled individually, but also in groups. Appropriate means, which are not shown here in detail, but are within the technical knowledge of those skilled in the art, are provided here. The formation box 8*g* can be filled with various media. The pressure elements in the formation box can be mounted in groups in the individual zones on a separate supporting frame or they can be mounted on a common supporting frame. The supporting frame is arranged in the formation box in such a way that the pressure values in the individual zones 74–76 are not influenced by the frame.

In the embodiment of the invention shown in FIG. 7, too, the design of the forming cylinder 4*g* as well as the filling of the formation box and the control of the pressure values are designed corresponding to the desired dewatering result. For example, the following are possible: (1) A forming cylinder with a storage volume and a formation box with pressure elements and an excess pressure; (2) A forming cylinder with a storage volume and a formation box with pressure elements and a reduced pressure; (3) A forming cylinder with a device for producing reduced pressure and a formation box with vacuum and pressure elements; (4) A forming cylinder with a device for producing reduced pressure and a formation box with excess pressure and pressure elements; and (5) A forming cylinder with a device for producing excess pressure and a formation box with reduced pressure and pressure elements.

In all of these designs, the influence on the pressure elements can be simply omitted, that is, all these designs can include formation boxes without pressure elements.

The subdivision of the formation box into several zones in the direction of movement of the wire belt makes it possible to achieve different dewatering force curves in the supporting region I. The profile can be influenced in that case by producing increased dewatering forces in the different regions of the supporting region. For example, one can conceive to have maximum dewatering forces in the first part of the supporting region and a reduction of the dewatering forces to the outlet or having a maximum dewatering performance in the middle region when going through the supporting region. These adjustments become necessary depending on the type of paper to control the filler distribution and sheet geometry.

Another dewatering unit 110 is disposed after (i.e. downstream) the forming cylinder 4*g* in the region of the twin-wire zone 1. This includes a cylinder 111, which supports the second wire belt 3 on its inner surface 9 and the first wire belt 2 on its outer surface 112 in the looping-around region 113 of the two wire belts 2 and 3 with the cylinder 111 with its surface 114. In the looping-around region, pressure elements 115, 116, and 117 are provided which drive pressure pulses onto the fibrous material suspension located between the two wire belts 2 and 3. The pressure elements can be designed as described in the previous figures. At an outlet 118 from the looping-around region 113, the two wire belts 2 and 3 are separated from one another. The fibrous material suspension is guided further with the wire belt 3. Further dewatering is done through a dewatering unit 119.

The examples described here in the figures are embodiments which are preferred conceivable embodiments according to the invention. The arrangement of a forming cylinder/formation box with or without a pressure element can be incorporated in various total concepts of twin-wire parts. However, multiple combinations of this arrangement are possible. The design of the forming cylinder and of the formation box as well as of its filling is also performed corresponding to the dewatering performance to be achieved and corresponding to the area weight profile of the fibrous material web.

Figure 8:
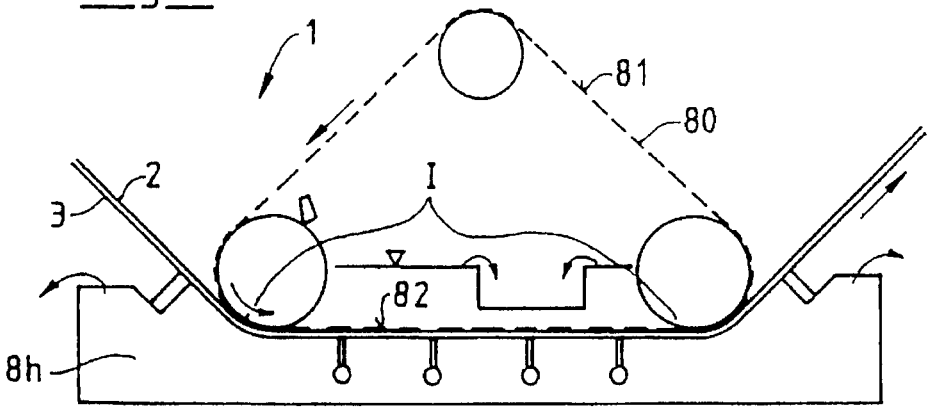
FIG. 8 is a partially schematic sectional view of a seventh embodiment of a wire part according to the invention showing an arrangement with a belt as a supporting element and a formation box.

FIG. 8 shows the possibility of using a belt instead of a forming cylinder as a supporting element. Here, too, a twin-wire zone 1 is formed from a continuous wire belt 2 and a continuous wire belt 3 by guiding them together along a certain path. In this region, the two wire belts are guided through a belt 80. This belt 80 can be permeable or impermeable to liquid. In the embodiment shown, this belt is preferably designed to be permeable to liquid. The belt 80 supports here with one part of its surface 81 the inner surface 6 of the first wire belt and the outer surface 7 of the second wire belt 3. This region is designated as a supporting region I. A formation box 8h is assigned to the supporting region I. This box can be arranged, when being filled with air or with liquid can produce a reduced or excess pressure on the inner side of the second wire belt. Also, pressure elements can be arranged in the formation box.

Various effects can be achieved with a belt/formation box arrangement. For example, when using an impermeable belt, one-sided dewatering in the direction of the second continuous wire belt 3 can be forced by applying a vacuum in the formation box. To realize two-sided dewatering as uniformly as possible, it is necessary to design the belt with a permeable surface. Then devices for producing reduced pressure or excess pressure can be provided within the belt, these becoming active in the region of the inner surface 82 of the belt in the supporting region. Here, too, the selection is done corresponding to the requirements of the individual case.

Figure 9:
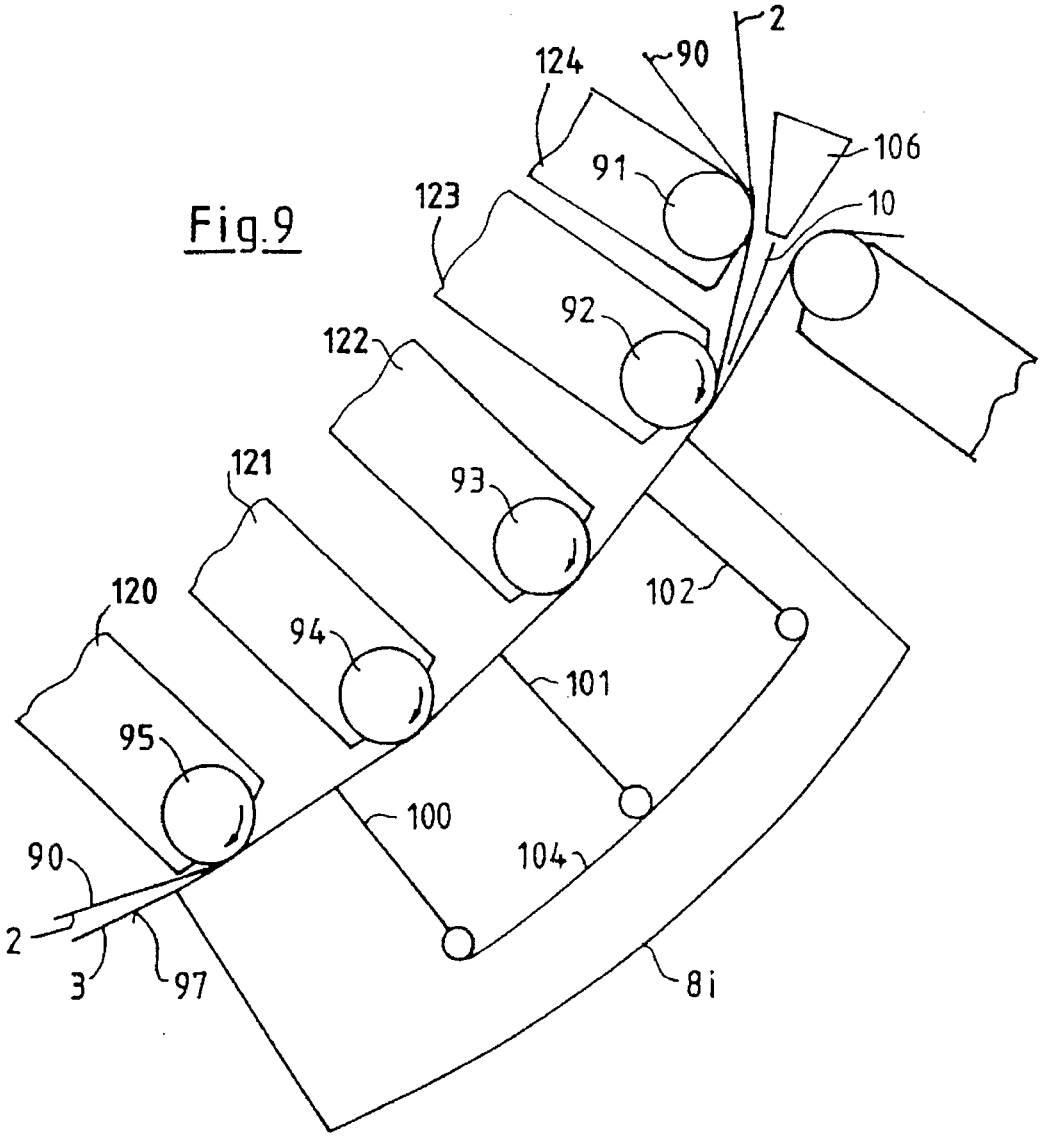
FIG. 9 is a partially schematic sectional view of an eighth embodiment of a wire part according to the invention showing apparatus for guidance and support of a belt.

FIG. 9 shows the possibility of guiding a continuous belt 90 over a number of guide rolls, which are only shown in a section from 91 to 96. However, it is possible to use guide shoes in addition to the guide rolls. In order to avoid bending, the guide rolls are mounted on holders 120, 121, 122, 123, 124, essentially along the width of the machine; these can be designed, for example, as described in DE 41 05 215 and can be mounted on a central supporting frame which is not shown here, so that the two wire belts 2 and 3 are supported on a surface 97 in a supporting region I. The surface 97 is defined by the polygonal guidance of a belt 90 through the guide rolls. A formation box is assigned to the belt 90 in the supporting region I where pressure elements 100 to 102 are mounted. The pressure elements can be mounted on a common supporting frame 104 located inside or outside the formation box **8*i*. The pressure elements are disposed in the formation box 8*i* against the guide rolls 91 to 96 in such a way that they are displaced so that they are opposite the gap between the guide rolls. This provides the advantage that the supporting surface 97** can avoid fibrous material suspension agglomerates to a limited extent.

In general, various elements can be utilized to guide a belt which can be permeable or impermeable to water. However, in each case, the belt is guided by a rotatably mounted roll. The supporting surface formed by the belt in the region of the twin-wire zone, which supports the two wire belts, can be a substantially flat surface or a curved surface. An almost curved surface is achieved by corresponding lining-up of the guide rolls at a small distance from each other. The belt is guided polygonally over the individual guide rolls. The larger the number of the guide rolls, the smaller the deviation of the polygonal track from a curve.

For designs with a closed belt, i.e., a belt which is impermeable to liquid, corresponding devices are to be provided in the direction of movement of the wire belt behind the belt arrangement to separate the two wire belts from the closed belt.

A design without a belt, that is, merely guiding the two wire belts through the guide rolls 91 to 95 is possible. Another variation is possible in which the arrangement according to FIG. 9 is upside down, that is, similarly to FIG. 6, the pulp jet 10 impinges essentially from down upward into the inlet gap between the two wires 2 and 3.

The foregoing detailed description is given for clearness of understanding only, and no unnecessary limitations should be understood therefrom, as modifications within the scope of the invention will be apparent to those skilled in the art.

We claim:

1. A method for the operation of a twin wire section of a papermaking machine for producing continuous fibrous material webs, the method comprising the steps of:

(a) providing a support element for supporting both first and second continuous wire belts in a support region of a twin-wire zone of the papermaking making machine, the support element supporting the first wire belt at an inner surface thereof facing toward the support element, and the support element supporting the second wire belt at an outer surface thereof also facing toward the support element;

(b) guiding a fibrous material web between the first and second continuous wire belts in the support region of the twin-wire zone; and (c) adjusting pressure only in the support region on an inner surface of the second wire belt, said second wire inner surface facing away from the support element, said pressure adjustment controllable between a partial vacuum and an excess pressure in the supporting region.

2. The method of claim 1 further comprising applying pressure pulses at certain points on the inner surface of the second wire belt in the support region, independently of the pressure conditions in the formation box.

3. A wire part of a machine for the production of continuous fibrous material webs, said wire part comprising:

(a) first and second continuous wire belts defining a twin-wire zone at a part of an extent of each of said belts;

(b) at least one supporting element having a supporting surface, said supporting surface supporting both said first and second wire belts at a support region of the twin-wire zone, said supporting surface supporting the first wire belt on an inner surface thereof facing toward the supporting surface and the second wire belt on an outer surface thereof facing toward the supporting surface;

(c) at least one formation box disposed in the support region, said formation box extending in a direction of movement of the first and second wire belts along at least a part of the support region;

(d) at least one pressure element contacting the second wire belt at an inner surface thereof facing away from the supporting surface, said at least one pressure element sealing the formation box against the atmosphere at said second wire belt inner surface; and (e) means for adjusting the pressure values in the formation box along the inner surface of the second wire belt.

4. The wire part of claim 3 wherein the formation box comprises a plurality of pressure zones extending in a direction of movement of the first and second wire belts, the number of pressure zones being controlled individually or in groups to adjust the pressure value in the formation box.

5. The wire part of claim 3 wherein said pressure adjusting means comprises at least one of an inlet line and an outlet line, each of said lines disposed on the formation box, having an adjustable cross-section, and for conveying a pressure medium.

6. The wire part of claim 5 wherein said pressure medium is in a liquid state.

7. The wire part of claim 5 wherein said pressure medium is in a gaseous state.

8. The wire part of claim 3 further comprising at least one additional pressure element disposed in the formation box for applying pressure on the inner surface of the second wire belt at certain pressure points independently of the pressure conditions in the formation box, said pressure points being distributed over the entire width of the wire belts.

9. The wire part of claim 3 wherein said at least one pressure element is one of a single pressure element extending across the width of the wire belts and a plurality of pressure elements covering the width of the wire belts.

10. The wire part of claim 9 wherein said at least one pressure element is a plurality of pressure elements, each element being rigidly designed.

11. The wire part of claim 9 wherein said at least one pressure element is a plurality of pressure elements, each element being non-rigidly designed.

12. The wire part of claim 11 wherein the pressure elements have zones of different bending stiffness along the width of the wire belts.

13. The wire part of claim 3 wherein the at least one pressure element can be pressed non-rigidly.

14. The wire part of claim 3 wherein the at least one pressure element comprises a plurality of pressure elements wherein the pressures applied by individual pressure elements can be adjusted variably in at least one of the direction of movement of the wire belts and along the width of the wire belts.

15. The wire part of claim 14 wherein the individual pressure elements are at least one of individually controlled and controlled in groups of pressure elements.

16. The wire part of claim 3 wherein the at least one pressure element comprises a plurality of pressure elements wherein the pressure elements are strips.

17. The wire part of claim 3 wherein a pressing surface of the at least one pressure element is convex.

18. The wire part of claim 3 wherein the at least one pressure element comprises a plurality of pressure elements wherein the pressure elements are metering rods.

19. The wire part of claim 3 wherein the at least one pressure element comprises a plurality of pressure elements wherein the pressure elements are pressing shoes each having a concave pressing surface.

20. The wire part of claim 3 wherein the at least one pressure element comprises a plurality of pressure elements wherein the pressure elements are blades.

21. The wire part of claim 3 wherein the at least one pressure element comprises a plurality of pressure elements wherein the pressure elements are rotatably mounted.

22. The wire part of claim 3 wherein a surface of the at least one pressure element in contact with the inner surface of the second wire belt is made of highly wear-resistant material.

23. The wire part of claim 22 wherein the surface of the pressure element in contact with the inner surface of the second wire belt is made of a ceramic material.

24. The wire part of claim 3 wherein the formation box and certain pressure elements are displacable together along the supporting surface in the support region.

25. The wire part of claim 3 wherein the formation box cannot be displaced in the mounting position and that certain pressure elements alone can be displaced along the supporting surface in the support region.

26. The wire part of claim 3 wherein the supporting element is a forming cylinder.

27. The wire part of claim 26 wherein the formation box and the at least one pressure element are arranged in the mounting position of the forming cylinder above a middle axis of the forming cylinder.

28. The wire part of claim 26 wherein the formation box and the at least one pressure element are arranged in the mounting position of the forming cylinder below a middle axis of the forming cylinder.

29. The wire part of claim 26 further comprising at least one additional pressure element disposed on one of the first and second wire belts at a position which is at least one of: upstream of the forming cylinder with respect to the direction of movement of the wire belts and downstream of the forming cylinder with respect to the direction of movement of the wire belts.

30. The wire part of claim 29 wherein the at least one pressure element comprises a plurality of pressure elements, said plurality of pressure elements other than the additional pressure element exert pressure on the inner surface of the second wire belt and are mounted in the formation box.

31. The wire part of claim 3 wherein the supporting element is a continuous belt.

32. The wire part of claim 31 wherein the continuous belt is permeable to water.

33. The wire part of claim 32 wherein the first wire belt is the supporting element.

34. The wire part of claim 31 wherein the belt is supported by a plurality of rolls extending along a width of the wire part, whereby the rolls are mounted on holders extending along the width of the wire part.

35. The wire part of claim 3 comprising a headbox disposed directly upstream the supporting surface and formation box arrangement with respect to a direction of conveyance of material through the wire part.

36. The wire part of claim 35 wherein additional dewatering elements are disposed between the headbox and the supporting surface and formation box arrangement.

37. The wire part of claim 3 further comprising additional dewatering units disposed downstream of the supporting surface and formation box arrangement with respect to a direction of conveyance of material through the wire part.

* * * * *